US011821627B2

(12) United States Patent
Michael et al.

(10) Patent No.: US 11,821,627 B2
(45) Date of Patent: Nov. 21, 2023

(54) METHOD AND HEATING UNIT FOR FLAME MONITORING DURING GAS COMBUSTION

(71) Applicant: ebm-papst Landshut GmbH, Landshut (DE)

(72) Inventors: Stephan Michael, Dresden (DE); Jens Hermann, Osnabrück (DE)

(73) Assignee: ebm-papst Landshut GmbH, Landshut (DE)

( * ) Notice: Subject to any disclaimer, the term of this patent is extended or adjusted under 35 U.S.C. 154(b) by 1 day.

(21) Appl. No.: 17/495,579

(22) Filed: Oct. 6, 2021

(65) Prior Publication Data

US 2022/0113027 A1 Apr. 14, 2022

(30) Foreign Application Priority Data

Oct. 12, 2020 (DE) ..... 10 2020 126 642.1

(51) Int. Cl.
*F23N 5/24* (2006.01)
*F23N 5/00* (2006.01)

(52) U.S. Cl.
CPC ..... *F23N 5/242* (2013.01); *F23N 5/003* (2013.01); *F23N 2900/05005* (2013.01)

(58) Field of Classification Search
CPC . F24N 5/003; F24N 5/242; F23N 2900/05005
USPC ..... 431/13, 76
See application file for complete search history.

(56) References Cited

U.S. PATENT DOCUMENTS

| | | | | |
|---|---|---|---|---|
| 2,545,732 | A | 3/1951 | Hamilton | |
| 2005/0120707 | A1* | 6/2005 | Pizzi | G01M 15/108 60/285 |
| 2017/0051913 | A1* | 2/2017 | Colannino | F23C 9/08 |

FOREIGN PATENT DOCUMENTS

| | | | |
|---|---|---|---|
| DE | 1253205 | B | 11/1967 |
| DE | 4447285 | A1 | 7/1996 |
| DE | 102005008617 | B3 | 7/2006 |
| DE | 102020121934 | | 5/2021 |
| EP | 2511611 | | 10/2012 |
| JP | 2010-14302 | | 1/2010 |

OTHER PUBLICATIONS

Palmer, P. E., and Weaver, E. R. Thermal-Conductivity Method for the Analysis of Gases. Technology Papers of the Bureau of Standards No. 249. Department of Commerce. 1924. (Year: 1924).*

(Continued)

*Primary Examiner* — Vivek K Shirsat
(74) *Attorney, Agent, or Firm* — Harness, Dickey & Pierce, P.L.C.

(57) ABSTRACT

A method of monitoring a flame during gas combustion in a combustion chamber (10). A heating unit (1) has an evaluation unit, an extraction line (11) and a sensor (12). The sensor (12) is arranged in the extraction line (11) to detect thermal substance properties of the gas. Thus, it is determined if it is ambient air (B), a non-combusted fuel-air mixture (C) or particularly the hydrogen-air mixture, or a waste gas (A) generated during combustion. The sensor (12) transmits a recorded measured value to the evaluation unit. The evaluation unit uses the measured value to determine whether ambient air (B), the non-combusted fuel-air mixture (C), or waste gas (A) is flowing through the extraction line (11) and thereby determines whether the flame is burning or extinguished.

15 Claims, 2 Drawing Sheets

(56) References Cited

OTHER PUBLICATIONS

Thermal conductivity gas analyzer ZAF—Fuji Electric Global (2016) (Year: 2016).*
Extended European Search Report dated Feb. 15, 2022 in corresponding European Application No. 21194515.9.
German Search Report dated Aug. 4, 2021 in corresponding German Application No. 10 2020 126 642.4.

* cited by examiner

METHOD AND HEATING UNIT FOR FLAME MONITORING DURING GAS COMBUSTION

CROSS-REFERENCE TO RELATED APPLICATION

This application claims priority to German Patent Application No. 10 2020 126 642.1 filed Oct. 12, 2020. The entire disclosure of the above application is incorporated herein by reference.

FIELD

The disclosure relates to a method of monitoring a flame during gas combustion in a heating unit, as well as, a heating unit that is enabled to monitor a flame during gas combustion where particularly hydrogen gas is combusted such that the flame is a hydrogen flame.

BACKGROUND

The heating units and particularly gas boilers known in the prior art currently use, for example, natural gas or long-chain hydrocarbons as fuel. In order to have safer operation of such heating units, flame monitoring is needed. Thus, it should be ensured that the supply of fuel is promptly stopped in the event the flame is extinguished.

If the supply of fuel is not stopped, fuel could collect, for example, in the combustion chamber. Thus, a sudden deflagration could occur due to a re-ignition or generally due to a spark.

The heating unit, the operator, and the environment should accordingly be protected by the flame monitoring.

Particularly in the household sector, flame monitoring takes place in a plurality of systems by the ionization current method. Due to the carbon contained in the fuel, charge carriers result during combustion. They can be measured as a so-called ionization current upon the application of a voltage. If this ionization current drops below a specified threshold value, it is assumed that the flame has been extinguished, and the supply of fuel is suppressed.

In the future, however, gas-fired heating units, and particularly gas boilers, will increasingly be operated with hydrogen and preferably with pure hydrogen.

This gaseous fuel does not contain any carbon fraction. Therefore, there is no ionization current that can be measured during the combustion of substantially pure hydrogen. Thus, one of the current most widely used forms of flame monitoring is no longer possible.

In addition to ionization current monitoring, there are also other methods known in the prior art where the flame is monitored directly, for example, by infrared or ultraviolet sensors.

However, these methods have the disadvantage that the sensors rely on visible contact with the flame. They can become soiled which leads to increased production and maintenance costs, in addition to increased design outlay.

Therefore, the object upon which the disclosure is based is to overcome the aforementioned disadvantages. The disclosure provides a method and/or a heating unit where reliable flame monitoring is enabled during gas combustion and also it is particularly suitable for monitoring hydrogen flame or hydrogen combustion.

SUMMARY

This object is achieved by the combination of features according to a method for monitoring a flame during gas combustion in a combustion chamber of a heating unit operated with gaseous fuel having an evaluation unit, an extraction line and a sensor. Waste gas flows through the extraction line during combustion. The sensor is arranged in the extraction line for detecting thermal substance properties of a gas flowing through the extraction line. The gas flowing through the extraction line is monitored. It is determined if the gas flow is ambient air from an environment adjoining the heating unit, a non-combusted fuel-air mixture, or a waste gas generated during combustion. A recorded measured value is transmitted to the evaluation unit. The evaluation unit, using the measured value, determines whether ambient air, the non-combusted fuel-air mixture, or waste gas is flowing through the extraction line, and accordingly determines whether the flame is burning or extinguished.

According to the disclosure, a method is proposed for monitoring a flame during gas combustion in a combustion chamber of a heating unit operated with gaseous fuel. The heating unit is particularly a gas boiler. To this end, the heating unit has an evaluation unit, an extraction line, where waste gas flows during combustion, and a sensor, arranged in the extraction line. The sensor detects thermal substance properties of a gas flowing through the extraction line. Preferably, the sensor is at least a sensor arranged in the extraction line. Preferably, several sensors may be provided that can detect the same or respectively different substance properties. In this case, the gas flowing through the extraction line is understood to be any gas or gas mixture that can flow through the extraction line (particularly during the intended proper use of the heating unit). The gas flowing through the extraction line, in this case, is at least ambient air from an environment adjoining the heating unit, a non-combusted fuel-air mixture, or a waste gas generated during combustion. In this case, the extraction line preferably connects the combustion chamber to the environment. The sensor transmits a recorded measured value to the evaluation unit. The measured value is recorded continually or discretely and can be transmitted to the evaluation unit continually or at predetermined time intervals. The evaluation unit determines whether ambient air, the non-combusted fuel-air mixture, or waste gas is flowing through the extraction line by the measured value or the substance properties representing the measured value. The substance properties is the gas flowing through the extraction line. Regardless of which gas is flowing through the extraction line, the evaluation unit further determines whether the flame is burning or extinguished. This is possible due to the fact that the gas flowing through the extraction line is directly associated with the presence of the flame.

If the supply of fuel is suppressed and no combustion is taking place, the ambient air flows through the extraction line or ambient air is present in the extraction line. If fuel is being supplied and the flame is extinguished, the non-combusted fuel-air mixture flows through the extraction line. If the flame is present, which is a requirement for the supply of fuel, waste gas flows through the extraction line.

The basic idea of the disclosure is to make use of the different thermal properties of ambient air, the non-combusted hydrogen or fuel-air mixture, and the waste gas from the gas combustion, and particularly the hydrogen combustion.

Examples of measurable substance properties include, for example, thermal conductivity k or thermal diffusivity a. The thermal substance properties of the non-combusted fuel-air mixture differ greatly from the gas mixtures otherwise present at the sensor. The substance properties of the gas mixture, that is flowing through the extraction line from the combustion chamber, are detected by the sensor. The gas or gas mixture is assigned to one of the classes of ambient air, non-combusted fuel-air mixture, or combusted waste gas based on the substance properties detected by the evaluation unit.

If a non-combusted mixture is detected, the supply of gas is stopped, even though the process had to have detected combusted waste gas. Accordingly, the evaluation unit transfers the status of the flame (burning or extinguished) to a control unit of the heating unit. Alternatively, the evaluation unit is integrated into such a control unit so that the detected gas and/or the determined status of the flame (actual status) can be compared to the status (target status) assumed or specified by the control unit.

Because the flame is not measured or monitored directly, this is considered an indirect method of flame monitoring.

Accordingly, an advantageous refinement of the method provides that the heating unit has a valve for controlling the supply of fuel. If the valve is closed, there is no more supply of fuel when a non-combusted fuel-air mixture is detected by the sensor or the evaluation unit, but a waste gas is still expected. To this end, a comparison of an actual and target status is not absolutely necessary, because it is usually not desirable for a non-combusted mixture to be flowing out due to the associated hazards.

Further, the combustion chamber is flushed with ambient air after detection that the flame is extinguished. This displaces a collection of non-combusted mixture (fuel-air mixture) from the combustion chamber and prevents a deflagration upon re-ignition of the flame in the combustion chamber. The successful flushing with ambient air can then be monitored by the sensor or by the method.

The air/gas or general pressure in the region of the sensor, as well as the temperature of the gas flowing past the sensor, is preferably constant. Auxiliary sensors detect boundary conditions prevailing in the extraction line such as, in particular, temperature and/or of the pressure where the boundary conditions in the extraction line can be verified and considered in the evaluation unit. If the temperature and/or pressure, for example, fluctuates, they can be used to normalize the detected substance properties of the gas into a comparable basis by conversion methods or conversion factors stored in the evaluation unit. In this case, the auxiliary sensors accordingly transmit the detected boundary conditions, as measured values to the evaluation unit, which normalizes the thermal substance properties detected by the sensors by the boundary conditions or standardizes them into predetermined comparable variables.

Preferably, a pressure that is greater than that in the environment adjoining the heating unit prevails in the combustion chamber. Thus, the waste gas flow or the flow through the extraction line is driven by the pressure difference.

An advantageous refinement additionally provides that the heating unit has several sensors for detecting thermal substance properties of the gas flowing through the extraction line. These are respectively arranged in the extraction line. The sensors may detect the respectively same or respectively different substance properties. Thus, a measured value can be verified, or the status of the flame can be determined based on various values.

In addition to the aforementioned substance properties, the individual sensor or sensors can be formed to detect a density or speed of sound as a substance property of the gas flows through the extraction line. Thus, the evaluation unit can determine the presence of the flame from the respective substance property based on the transmission of the respective measured values recorded by the sensor or sensors.

As previously mentioned, an advantageous refinement provides that the fuel is a hydrogen gas mixture or preferably a pure hydrogen gas. A pure hydrogen gas is understood to be a substantially pure hydrogen gas that is only insignificantly impure. For example, the hydrogen gas mixture could be a hydrogen CH4 mixture.

In addition to the monitoring of a gas combustion of particularly pure hydrogen gas or hydrogen gas mixtures, further gaseous fuels or gases can also be used as the gaseous fuels that can be used in the method. It is essential in this case that the thermal substance properties differ sufficiently among ambient air, waste gas, and gaseous fuel in order to be reliably detected by a corresponding sensor and differentiated in the evaluation unit by the respective measured values. In particular, natural gas can be used as the gaseous fuel for use in the proposed method. With most liquefied gases, it is not possible to have a clear distinction between waste gas and a fuel-air mixture due to the low thermal conductivity as compared to ambient air.

This means that the method is particularly suitable for monitoring a flame during gas combustion that uses a gaseous fuel. The primary fraction is hydrogen, or is a mixture of hydrogen and a gas of the second family of gases (natural gas). A gas from the second family of gases (natural gas) includes a mixture of air and propane. The added mixture of air and propane together has a volume fraction of less than 40%.

Especially advantageous is a variant where the sensor is formed to detect a thermal conductivity k and/or a thermal diffusivity a of the gas flowing through the extraction line. Thus, due to the thermal conductivity and the thermal diffusivity of the various gases flowing through the extraction line, which differ greatly, a change is very easy to detect.

Depending on the operating parameters of the sensor specifically used, the sensor may have a particular permissible temperature range where it can operate. Furthermore, it is advantageous to always take the measurement of the substance properties at a predetermined or at least constant temperature. If the flow of waste gas or generally the gas flowing through the extraction line is too hot, it can include an advantageous refinement where the gas flowing through the extraction line is cooled down. It is cooled by a cooling device that is arranged along the flow path from the combustion chamber, through the extraction line, to the sensor before that sensor. In this case, the cooling device can be formed to cool down the gas to a certain temperature or by a predetermined temperature difference. Thus, the temperature of the gas passing the sensor is preferably within a temperature range permissible for the sensor or for measuring the substance properties.

It is further advantageous when a volumetric flow of the gas flowing through the extraction line or generally the flow or the gas quantity of the gas flowing through the extraction line can be controlled by a throttling element. To this end, the heating unit preferably comprises a throttling element that is arranged along the flow path from the combustion chamber, through the extraction line, to the sensor after or before that sensor.

Preferably, the sensor leads from the combustion chamber, via the sensor, to the environment adjoining the heating unit. The extraction line has an outlet toward the environment. In this case, the throttling element is arranged along the flow path of the gas after or before the sensor and before the outlet.

In order to actually detect the waste gas resulting during combustion or to route it into the extraction line, the extraction line in the combustion chamber has an inlet, preferably precisely one inlet. The inlet is arranged in a direct vicinity of the flame or a burner generating the flame. Thus, the waste gas resulting during combustion flows directly into the extraction line through the inlet and is routed through the extraction line to the sensor.

An especially advantageous refinement further provides that the heating unit has a primary waste gas line such as, for example, a flue. A first partial stream of the waste gas generated during combustion flows through the extraction line. A second partial stream of the waste gas generated during combustion flows through the primary waste gas line during combustion. The ratios between the partial flows can be controlled particularly when combined with a throttling element in the extraction line. Preferably, the partial flow through the primary waste gas line is greater than the partial flow through the extraction line, which is essentially only used to route a flow of waste gas determined for flame monitoring.

Alternatively, the extraction line may function integrally as a primary waste gas line or a flue. Thus, the heating unit does not have two separate lines but instead has one extraction line functioning as a flue.

With a likewise advantageous embodiment of the method, the combustion chamber and the extraction line are flushed with ambient air before the start of combustion. In this case, the substance properties of the ambient air are measured by the sensor. The properties can then be used as a reference value and stored in the evaluation unit, for example, before each ignition starting the combustion.

The thermal properties or, for example, the thermal conductivity k or the thermal diffusivity a of the mixture of water vapor, nitrogen, and oxygen (waste gas) is less than that of the ambient air at the same temperature. If a flame goes out during operation, the non-combusted fuel-air mixture passes by the sensor. The thermal properties, or particularly, the thermal conductivity k, or the thermal diffusivity a is far greater than the properties of the waste gas or corresponding ambient air.

To enable flame monitoring by the detected thermal substance properties, there are basically two variants that can be combined.

With the first variant, the evaluation unit compares the measured value or values transmitted by the sensor, preferably during the entire operation, continually or at predetermined intervals with a predetermined threshold value or at least a value range. Thus, it determines, from the comparison of the measured value or values, whether ambient air, the non-combusted fuel-air mixture, or waste gas is flowing through the extraction line.

The strong differences between the detected thermal substance properties of the various gases can be depicted in the threshold values or value ranges. Thus, when the values drop below or go above the threshold, it can be determined which gas or gas mixture is flowing past the sensor. Accordingly, it is determined whether the flame is burning or extinguished.

In the second variant, the evaluation unit determines a rate of change of the measured value from two or more sequentially determined measured values. Due to the fact that the rate of change should be essentially "0" during stable operation, a change of rate, the amount of the rate change, or even solely the sign of the change rate can determine whether there is a change in the flame. If the rate of change is determined or tracked from the start of combustion, it can be determined whether the flame is extinguished or burning. Accordingly, the rate of change is used with this variant to determine whether ambient air, the non-combusted fuel-air mixture, or waste gas is flowing through the extraction line. If the monitoring takes place using the rate of change, a tolerance range can be provided. Thus, smaller fluctuations do not lead to unintentional suppression of the supply of fuel. The rate of change can also be determined and added up over the time of operation, where the extinguishing of the flame can be assumed when the rate of change exceeds a predetermined limit or threshold value.

A further aspect of the disclosure relates to a heating unit with a combustion chamber, an evaluation unit, and an extraction line. It is possible for waste gas resulting during combustion in the combustion chamber to flow through the extraction line. A sensor is arranged in the extraction line. The sensor detects a thermal substance property of a gas flowing through the extraction line by recording a measured value. In doing so, the sensor is connected to the evaluation unit in order to transmit the measured value or measured values determined over time by the sensor. In addition, the evaluation unit is formed to determine, from the measured value or measured values, whether ambient air, a non-combusted fuel-air mixture, or waste gas is flowing through the extraction line. Thus, this determines whether a flame is burning in the combustion chamber or is extinguished.

Preferably, the heating unit is formed by implementing the method according to the disclosure.

The previously disclosed features can be combined as desired to the extent that this is technically feasible and said features do not contradict one another.

Further areas of applicability will become apparent from the description provided herein. The description and specific examples in this summary are intended for purposes of illustration only and are not intended to limit the scope of the present disclosure.

DRAWINGS

Other advantageous further developments of the disclosure are identified in the dependent claims or presented below together with the description of the preferred embodiment of the disclosure with reference to the figure.

DETAILED DESCRIPTION

Figure 1:
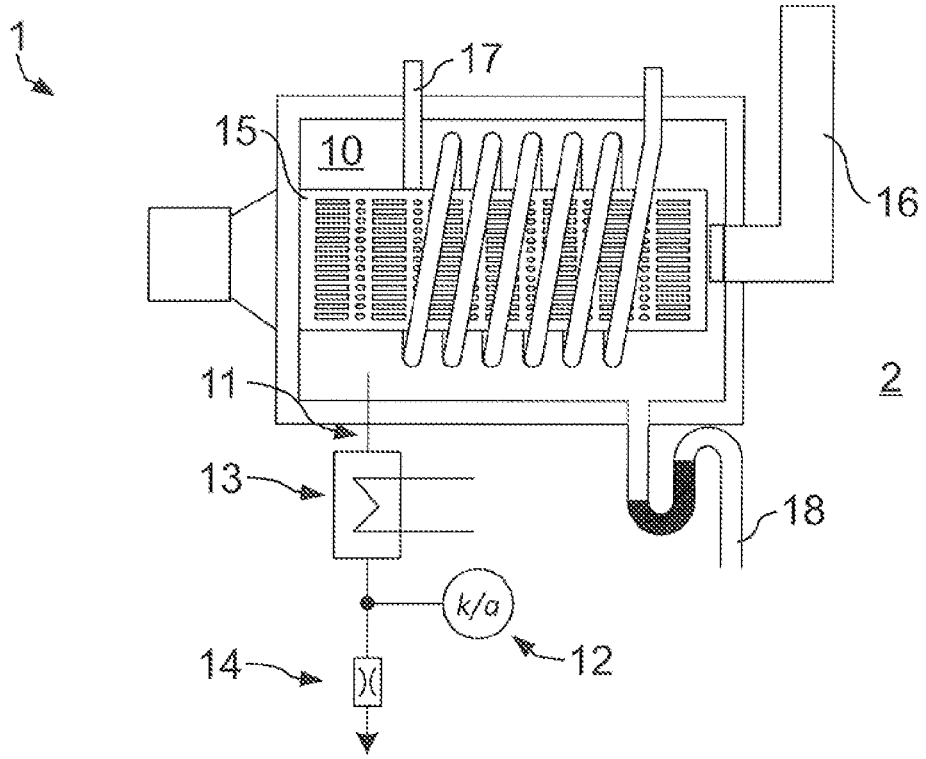
FIG. 1 is a schematic view of a first variant of a heating unit.

The figures are schematic examples. The same reference numerals in the figures indicate equivalent functional and/or structural features.

FIG. 1 shows a first variant of a heating unit 1 according to the disclosure, with which the method according to the disclosure can be implemented.

The sensor 12 measures the thermal substance properties of the waste gas resulting during combustion in the combustion chamber 10. The waste gas is routed from the combustion chamber 10 to the environment 2 through the extraction line 11. In this case, the flow through the extraction line 11 is a partial flow. A flue is provided as the primary waste gas line 16. Due to the flue, waste gas likewise flows from the combustion chamber 10 into the environment 2 during combustion. The sensor 12 is exposed to the partial flow of waste gas removed from the combustion chamber 10. Thus, the sensor 12 can detect the thermal substance properties of the gas or gas mixture flowing by it.

The waste gas is removed in the direct vicinity of the burner 15. Thus, the waste gases generated during combustion flow directly into the extraction line 11. It can also be characterized as the extraction line.

In this case, a pressure higher than that in the environment 2 prevails in the interior of the combustion chamber 10. Thus, the waste gases are conveyed due to the pressure difference from the combustion chamber 10.

Furthermore, a throttling element 14 is provided to regulate and control the flow of waste gas or the partial flow of waste gas through the extraction line 11.

An optional cooling device 13 is further provided with the variant shown in FIG. 1. The cooling device cools the gas flowing through the extraction line 11 before it reaches the sensor 12. The cooling of the gas means that the gas flowing to the sensor 12 has a preferably constant temperature. Thus, the thermal substance properties measured in the various gases are comparable.

In the embodiment according to FIG. 1, the heating unit further has a heat exchanger 17. The heat generated by the burner 15 or from the combustion chamber 10 during combustion can be discharged and rendered usable with heat exchanger 17.

In addition, a condensate drain 18 discharges condensate occurring in the combustion chamber 10 from the combustion chamber 10.

Figure 2:
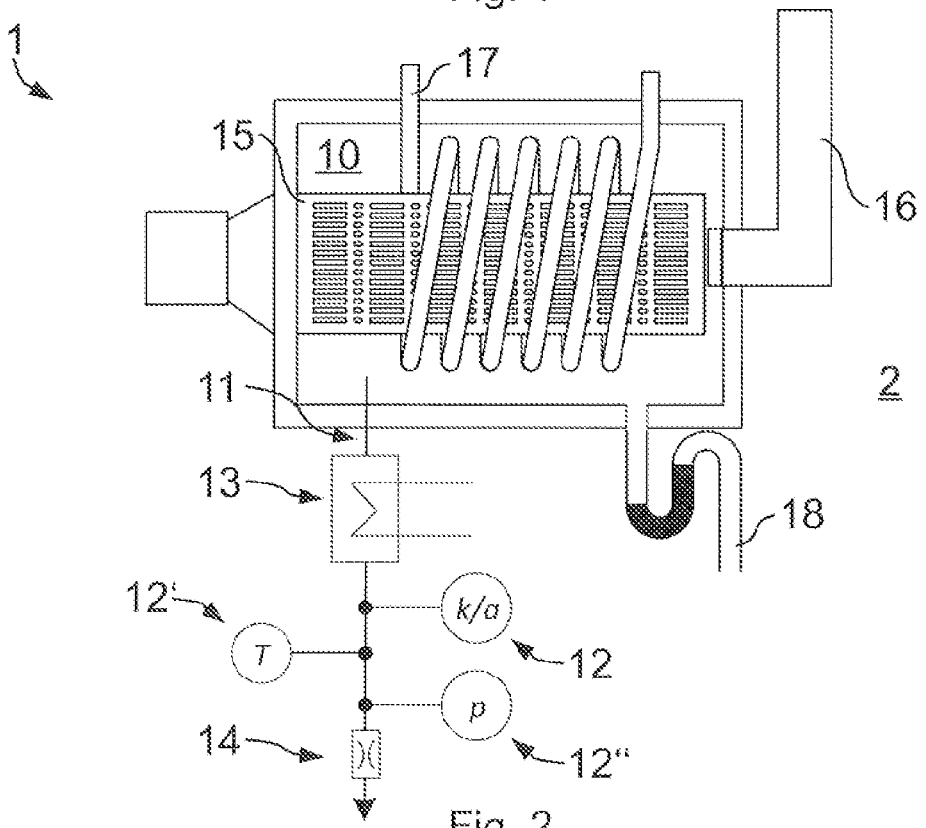
FIG. 2 is a schematic view of a second variant of a heating unit.

The variant of the heating unit 1 shown in FIG. 2, which is preferably formed as a gas boiler, has two sensors 12', 12', in addition to the components described in relation to FIG. 1. The sensors detect further properties of the gas flowing through the waste gas line 11. These additional sensors would be a temperature sensor 12' and a pressure sensor 12". In the variant shown by example, the measured values determined from the three sensors 12, 12', 12" are each transmitted to the evaluation unit. The evaluation unit determines whether the flame is extinguished or not based on all measured values. To this end, values recorded, for example, by the sensor 12 can be normalized based on a respective temperature determined by the temperature sensor 12' and part of the value and a likewise corresponding pressure detected by the pressure sensor 12". Thus, the various values recorded by the sensor 12 are comparable and can optionally be collated with a table or with characteristic values stored in the evaluation unit. Thus, a determination can reliably be made as to whether the gas in the extraction line is waste gas, ambient air, or the non-combusted fuel-air mixture or whether the flame is extinguished or present.

With the variant as it is shown in FIG. 1 as well as with the variant as it is shown in FIG. 2, the throttling element 14 may alternatively be arranged upstream of the optional cooling device 13. In the event there is no cooling device 13, it is arranged upstream of the sensor 12 or sensors 12, 12', 12", as it relates to the flow direction.

Figure 3:
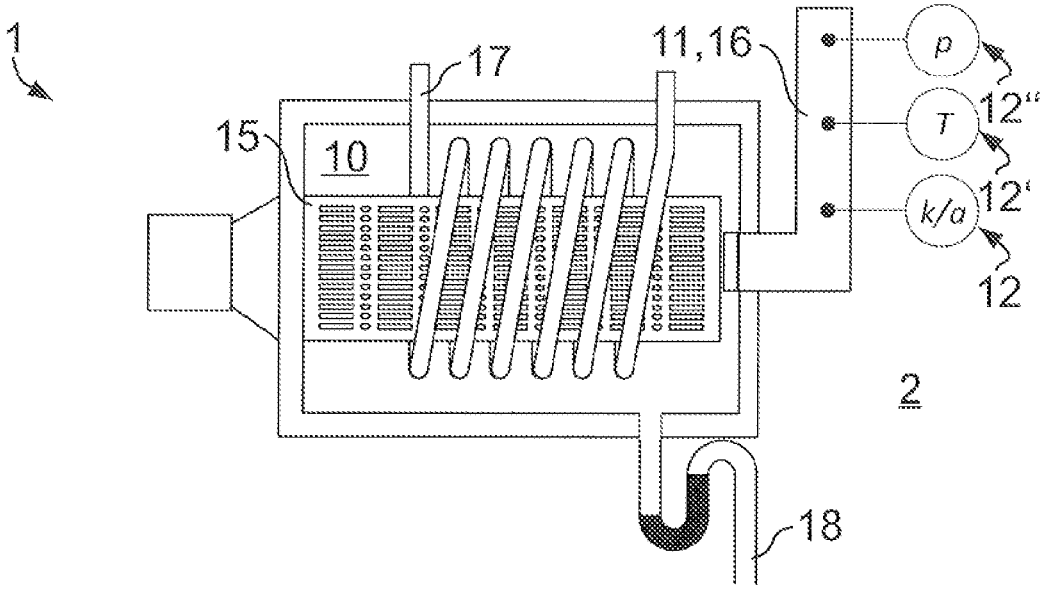
FIG. 3 is a schematic view of a third variant of a heating unit.

FIG. 3 shows a variant of the heating unit 1. Similar to the variant according to FIG. 2, three sensors 12, 12', 12" are provided along the extraction line 11, which, however, is integrated into the primary waste gas line 16 or into the flue 16 in this case. Thus, there is no separate extraction line 11 or separate primary waste gas line 16. Nevertheless, a separate region can be provided in the primary waste gas line 16, wherein which only a part of the gas flows through the region and where the sensors 12, 12", 12" are arranged and a measurement is taken. Furthermore, the embodiment according to FIG. 3 does not have a cooling device 13. Thus, a temperature fluctuation in the gases can be considered using a measurement of the temperature of the temperature sensor 12'.

Figure 4:
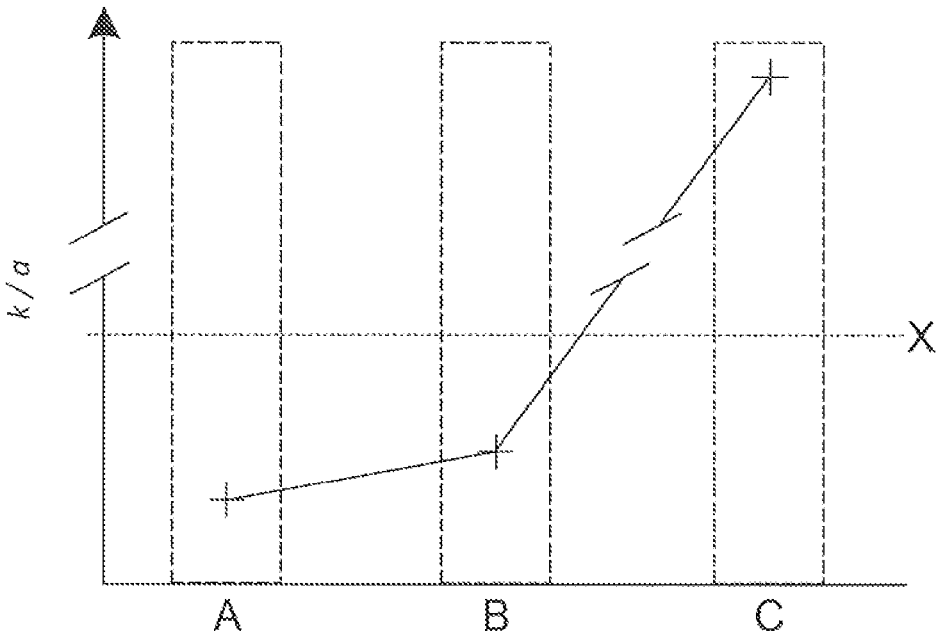
FIG. 4 is a schematic view of thermal substance properties of various gases.

FIG. 4 shows a comparison of the thermal conductivity k or the thermal diffusivity a of the media flowing past the sensor 12, i.e. of ambient air B from an environment 2 adjoining the heating unit 1, a non-combusted fuel-air mixture C, or a waste gas A generated during combustion. The functional principle of flame monitoring of the evaluation unit should be clarified.

Due to the application of the thermal substance properties of the various gases at a constant temperature in FIG. 4, it is clear that the thermal properties of the three substantially different gases, that can flow past the sensor 12, deviate significantly from one another at the same temperature and preferably same pressure or air pressure. Thus, the gases can be differentiated from one another by the detected substance property. The thermal substance properties of the waste gas A are less than those of the ambient air B. If the flame goes out during operation, the flame is extinguished, the non-combusted hydrogen-air mixture or fuel-air mixture C passes the sensor 12. Thus, the threshold value X shown as an example is exceeded. When the measured value exceeds the threshold value X, it can thus be detected, for example, when the flame is extinguished, and the supply of fuel will be stopped.

In addition to the thermal substance properties of the waste gas A and of the non-combusted fuel-air mixture C, the substance properties of the ambient air B are also shown. The substance properties are detectable as a reference value, for example, during flushing of the extraction line 11 with ambient air B before the ignition of combustion. In addition, the correspondingly selected threshold values can be used to determine whether flushing of the combustion chamber before the start of combustion, before ignition, or after the flame is extinguished was successful.

If the measured values fall below or exceed the correspondingly selected limit or threshold values, respective gas A, B, or C can be detected, and conclusions can be drawn about the presence of the flame.

The disclosure is not limited in its design to the aforementioned preferred exemplary embodiments. Rather, a number of variants is conceivable, which would make use of the solution shown even with essentially different designs.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A method for monitoring a flame during gas combustion in a combustion chamber of a heating unit operated with pure hydrogen having an evaluation unit, an extraction line, through which waste gas flows during combustion, and a sensor arranged in the extraction line for detecting thermal substance properties of a gas flowing through the extraction line, comprising:

monitoring the gas flowing through the extraction line;

determining if the gas flow is ambient air from an environment adjoining the heating unit, a non-combusted fuel-air mixture, where the fuel is pure hydrogen, or a waste gas generated during combustion, transmitting a recorded measured value to the evaluation unit;

determining, via the evaluation unit, using the measured value, whether ambient air, the non-combusted fuel-air mixture, where the fuel is pure hydrogen, or waste gas is flowing through the extraction line; and determining whether the flame is burning or extinguished.

2. The method according to claim 1, wherein the sensor detects a thermal conductivity k and/or a thermal diffusivity a of the gas flowing through the extraction line.

3. The method according to claim 1, wherein the heating unit has several sensors arranged in the extraction line in order to detect thermal substance properties of the gas flowing through the extraction line that respectively detect the same or different thermal substance properties.

4. The method according to claim 1, wherein the heating unit has at least one auxiliary sensor arranged in the extraction line in order to detect boundary conditions prevailing in the extraction line, wherein the at least one auxiliary sensor transmits the detected boundary conditions to the evaluation unit, as measured values, and the evaluation unit normalizes the detected thermal substance properties via the sensor based on the boundary conditions detected by the at least one auxiliary sensor.

5. The method according to claim 1, further comprising cooling the gas flowing through the extraction line by a cooling device, arranged along the flow path from the combustion chamber, through the extraction line, to the sensor before that sensor.

6. The method according to claim 1, further comprising controlling a volumetric flow of the gas flowing through the extraction line by a throttling element, arranged along the flow path from the combustion chamber, through the extraction line, to the sensor after or before that sensor.

7. The method according to claim 1, wherein the extraction line in the combustion chamber has an inlet, arranged in a direct vicinity of the flame or a burner generating the flame such that the waste gas resulting during combustion flows directly into the extraction line through the inlet and is routed through the extraction line to the sensor.

8. The method according to claim 1, wherein the heating unit has a primary waste gas line and a first partial stream of the waste gas generated during combustion flows through the extraction line and a second partial stream of the waste gas generated during combustion flows through the primary waste gas line during combustion.

9. The method according to claim 1, further comprising flushing the combustion chamber and the extraction line with ambient air before a start of combustion, and the substance properties of the ambient air are measured by the sensor during the flushing.

10. The method according to claim 1, wherein the evaluation unit compares the measured value with a predetermined threshold value or at least a value range and determines from the comparison of the measured value whether ambient air, the non-combusted fuel-air mixture, where the fuel is pure hydrogen, or waste gas is flowing through the extraction line.

11. The method according to claim 1, wherein the evaluation unit determines a rate of change of the measured value from two or more sequentially determined measured values;

and wherein the rate of change is used to determine whether ambient air, the non-combusted fuel-air mixture, or waste gas is flowing through the extraction line.

12. A heating unit comprising:

a combustion chamber;

an evaluation unit, and an extraction line, it being possible for waste gas resulting during gas combustion of a pure hydrogen in the combustion chamber to flow through the extraction line;

a sensor arranged in the extraction line, the sensor detecting a thermal substance property of a gas flowing through the extraction line by recording a measured value, the sensor is connected to the evaluation unit in order to transmit the measured value, and the evaluation unit uses the measured value to determine whether ambient air, a non-combusted fuel-air mixture, where the fuel is pure hydrogen, or waste gas is flowing through the extraction line and determines whether a flame in the combustion chamber is burning or extinguished.

13. The heating unit according to claim 12, wherein the heating unit implements the method according to claim 1.

14. A method for monitoring a flame during gas combustion in a combustion chamber of a heating unit operated with gaseous fuel having an evaluation unit, an extraction line, through which waste gas flows during combustion, and a sensor arranged in the extraction line for detecting thermal substance properties of a gas flowing through the extraction line, comprising:

monitoring the gas flowing through the extraction line;

determining if the gas flow is ambient air from an environment adjoining the heating unit, a non-combusted fuel-air mixture, or a waste gas generated during combustion, transmitting a recorded measured value to the evaluation unit;

determining, via the evaluation unit, using the measured value, whether ambient air, the non-combusted fuel-air mixture, or waste gas is flowing through the extraction line;

determining whether the flame is burning or extinguished; and the heating unit has at least one auxiliary sensor arranged in the extraction line in order to detect boundary conditions prevailing in the extraction line, the at least one auxiliary sensor transmits the detected boundary conditions to the evaluation unit, as measured values, and the evaluation unit normalizes the detected thermal substance properties via the sensor based on the boundary conditions detected by the at least one auxiliary sensor.

15. A method for monitoring a flame during gas combustion in a combustion chamber of a heating unit operated with gaseous fuel having an evaluation unit, an extraction line, through which waste gas flows during combustion, and a sensor arranged in the extraction line for detecting thermal substance properties of a gas flowing through the extraction line, comprising:

monitoring the gas flowing through the extraction line;

determining if the gas flow is ambient air from an environment adjoining the heating unit, a non-combusted fuel-air mixture, or a waste gas generated during combustion, transmitting a recorded measured value to the evaluation unit;

determining, via the evaluation unit, using the measured value, whether ambient air, the non-combusted fuel-air mixture, or waste gas is flowing through the extraction line; and controlling a volumetric flow of the gas flowing through the extraction line by a throttling element, arranged along the flow path from the combustion chamber, through the extraction line, to the sensor after or before that sensor;

determining whether the flame is burning or extinguished.

* * * * *